US006720736B2

(12) United States Patent
Lee et al.

(10) Patent No.: US 6,720,736 B2
(45) Date of Patent: Apr. 13, 2004

(54) PLASMA DISPLAY PANEL

(75) Inventors: Eun Cheol Lee, Kumi-shi (KR); Jae Sung Kim, Kumi-shi (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 10/024,310

(22) Filed: Dec. 21, 2001

(65) Prior Publication Data

US 2002/0101181 A1 Aug. 1, 2002

(30) Foreign Application Priority Data

Dec. 22, 2000 (KR) ..... P2000-79994
Dec. 30, 2000 (KR) ..... P2000-87062
Feb. 1, 2001 (KR) ..... P2001-4745

(51) Int. Cl.[7] ..... H05B 41/00
(52) U.S. Cl. ..... 315/169.3; 315/169.4
(58) Field of Search ..... 315/169.3, 169.4, 315/169.1, 169.2; 313/485, 495, 581, 492, 582, 585, 587; 445/24

(56) References Cited

U.S. PATENT DOCUMENTS 6,031,329 A 2/2000 Nagano ..... 313/582
6,195,070 B1 * 2/2001 Shinoda et al. ..... 345/60
6,380,691 B2 * 4/2002 Eo ..... 315/169.4
6,411,043 B1 * 6/2002 Jeong et al. ..... 315/169.3
2001/0011974 A1 * 8/2001 Kang et al. ..... 345/60

FOREIGN PATENT DOCUMENTS

| | | |
|---|---|---|
| JP | 5-266800 | 10/1993 |
| JP | 10-326570 | 1/1998 |
| JP | 10-333636 | 1/1998 |
| JP | 2000-223034 | 8/2000 |
| KR | 1020020012948 | 2/2002 |

* cited by examiner

*Primary Examiner*—Don Wong
*Assistant Examiner*—Chuc Tran
(74) *Attorney, Agent, or Firm*—Fleshner & Kim, LLP

(57) ABSTRACT

There is disclosed a plasma display panel that is capable of improving its discharge efficiency and brightness.

A plasma display panel according to the present invention includes an upper electrode group formed on an upper substrate, including a scanning electrode to which a scanning voltage is supplied, barrier ribs formed on a lower substrate facing the upper substrate with a discharge space therebetween for dividing the discharge space; and an address electrode formed on the lower substrate to be located under the barrier ribs, and to which a data voltage is supplied.

23 Claims, 15 Drawing Sheets

PLASMA DISPLAY PANEL

BACKGROUND OF THE INVENTION

1. Field of the Invention

This invention relates to a plasma display panel, and more particularly to a plasma display panel that is capable of improving its discharge efficiency and brightness.

2. Description of the Related Art

Generally, a plasma display panel (PDP) radiates a fluorescent body by an ultraviolet ray generated during a gas discharge to thereby display a picture including characters and graphics. Such a PDP is easy to be made into a thin-film and large-dimension type. Moreover, the PDP provides a very improved picture quality owing to a recent technical development.

Referring to FIG. 1, a conventional three-electrode, AC surface-discharge PDP includes a scanning electrode Y and a sustaining electrode Z provided on an upper substrate 10, and a data electrode X provided on a lower substrate 18.

The scanning electrode Y and the sustaining electrode Z have transparent electrodes 12Y and 12Z with a large width and metal bus electrodes 13Y and 13Z with a small width, respectively, and are formed on the upper substrate in parallel. An upper dielectric layer 14 and a protective film 16 are disposed on the upper substrate 10 in such a manner to cover the scanning electrode Y and the sustaining electrode Z. Wall charges generated upon plasma discharge are accumulated in the upper dielectric layer 14. The protective film 16 prevents a damage of the upper dielectric layer 14 caused by a sputtering during the plasma discharge and improves the emission efficiency of secondary electrons. This protective film 16 is usually made from magnesium oxide (MgO). The data electrode X Is perpendicular to the scanning electrode Y and the sustaining electrode Z.

A lower dielectric layer 22 and barrier ribs 24 are formed on the lower substrate 18. The surfaces of the lower dielectric layer 22 and the barrier ribs 24 are coated with a fluorescent material layer 26. The barrier ribs 24 separate adjacent discharge spaces in the horizontal direction to thereby prevent optical and electrical crosstalk between adjacent discharge cells. The fluorescent layer 26 is excited by an ultraviolet ray generated during the plasma discharge to generate any one of red, green and blue visible light rays. An inactive mixture gas of He+Xe, Ne+Xe or He+Xe+Ne is injected into a discharge space defined between the upper and lower substrate 10 and 18 and the barrier rib 24.

Discharge cells of such a PDP are arranged at a panel 30 in a matrix pattern as shown in FIG. 2. The scanning electrodes Y1 to Ym and the sustaining electrodes Z1 to Zm arranged in parallel cross the data electrodes X1 to Xn at each discharge cell.

Such a PDP drives one frame, which is divided into various sub-fields having a different discharge frequency, so as to realize gray levels of a picture. Each sub-field is again divided into a reset interval for uniformly causing a discharge, an address interval for selecting the discharge cell and a sustaining interval for realizing the gray levels depending on the discharge frequency.

For instance, when it is intended to display a picture of 256 gray levels, a frame interval equal to 1/60 second (i.e. 16.67 msec) is divided into 8 sub-fields SF1 to SF8 as shown in FIG. 3. Each of the 8 sub-fields SF1 to SF8 is again divided into a reset interval, an address interval and a sustaining interval. The reset interval and the address interval of each sub-field are equal every sub-field. The address discharge for selecting the cell is caused by a voltage difference between the data electrode X and the scanning electrode Y. The sustaining interval is increased at a ration of $2^n$ (wherein n=0, 1, 2, 3, 4, 5, 6 and 7) at each sub-field. A sustaining discharge frequency in the sustaining interval is controlled at each sub-field in this manner, to thereby realize a gray scale required for a picture display. The sustaining discharge is generated by a high voltage of pulse signal applied alternately to the scanning electrode Y and a sustaining electrode z. FIG. 4 illustrates driving waveforms: the three-electrode PDP.

Referring to FIG. 4, in the reset interval, signals of square wave or ramp wave type (not shown) are supplied at least once to the sustaining electrode Z or the scanning electrodes Y1 to Ym to simultaneously discharge the discharge cells of the entire screen. Uniform wall charges are accumulated within the cells of the entire screen by the discharge during the reset interval.

In the address interval, a scanning pulse Sp with a negative polarity is sequentially applied to the scanning electrodes Y1 to Ym and a data pulse Vd synchronized with the scanning pulse Sp is applied to the data electrode X. An address discharge is generated at the discharge cell supplied with the data pulse Vd.

In the sustaining interval, a sustaining pulse Vs are alternately applied to the scanning electrode Y and the sustaining electrode Z. Then, the discharge calls selected by the address discharge generates a sustaining discharge continuously whenever the sustaining pulse Vs is applied.

Since such a three-electrode FDP has the scanning electrode Y and the sustaining electrode Z positioned at the upper center of the discharge space, it has a low utility of the discharge space. For this reason, in the three-electrode PDP, a voltage for causing a sustaining discharge and a power consumption are high while discharge and light-emission efficiencies daring the sustaining discharge are low. More specifically, the sustaining discharge takes a surface discharge between the scanning electrode Y and the sustaining electrode Z. However, since the scanning electrode Y and the sustaining electrode Z concentrate at the center of the cell to lower a discharge-initiating voltage, a discharge path becomes short to cause low discharge and light-emission efficiencies. When a distance between the scanning electrode Y and the sustaining electrode is enlarged so as to enhance the efficiencies, a discharge-initiating voltage becomes high in proportional to a distance between the two electrodes.

In order to solve the problems of the three-electrode PDP, there has been suggested a five-electrode PDP in which an electrode for causing a sustaining discharge is divided into four electrodes, Referring to FIG. 5, the conventional five-electrode PDP includes a pair of trigger electrodes TY and TZ provided on an upper substrate 34 in such a manner to be positioned at the center of a discharge cell, a pair of sustaining electrodes SY and SZ provided on the upper substrate 34 in such a manner to have the pair of trigger electrodes TY and TZ therebetween and to be positioned at the edge of the discharge cell, and a data electrode X provided at a lower substrate 40 in such a manner to be perpendicular to the trigger electrodes TY and TZ and the sustaining electrodes SY and SZ.

The pair of trigger electrodes TY and TZ and the pair or sustaining electrodes SY and SZ include transparent electrodes having a large width and metal bus electrodes having a small width, respectively, and are formed on the upper substrate 34 in parallel. The pair of trigger electrodes TY and TZ are set to have a small distance Ni between the electrodes.

The pair of sustaining electrodes SY and SZ are set to have a large distance Wi between the electrodes. The pair of sustaining electrodes SY and SZ causes a long-path discharge by utilizing space charges and wall charges formed by a discharge between the pair of trigger electrodes TY and TZ.

An upper dielectric layer 36 and a protective film 38 are disposed on the upper substrate 34 in such a manner to cover the pair of trigger electrodes TY and TZ and the pair of sustaining electrodes SY and SZ, Wall charges generated upon plasma discharge are accumulated in the upper dielectric layer 36. The protective Film 38 prevents a damage of the upper dielectric layer 36 caused by a sputtering during the plasma discharge and improves the emission efficiency of secondary electrons. This protective film 38 is usually made from magnesium oxide (MgO).

A lower dielectric layer 44 and barrier ribs 46 are formed on the lower substrate 40. The surfaces of the lower dielectric layer 44 and the barrier ribs 46 are coated with a fluorescent material layer 48. The barrier ribs 46 separate adjacent discharge spaces in the horizontal direction to thereby prevent optical and electrical crosstalk between adjacent discharge cells. The fluorescent material layer 48 is excited by an ultraviolet ray generated during the plasma discharge to generate any one of red, green and blue visible light rays. An inactive mixture gas of He+Xe, Ne+Xe or He+Xe+Ne is injected into a discharge space defined among the upper and lower substrate 34 and 40 and the barrier ribs 46.

Discharge cells of such a five-electrode PDP are arranged at a panel 5O in a matrix pattern as shown in FIG. 6.

Like the three-electrode PDP, the five-electrode AC surface-discharge PDP drives one frame, which is divided into various sub-fields each of which includes a reset interval, an address interval and a sustaining interval and has a different discharge frequency, so as to realize gray levels of a picture.

During the reset interval, the discharge cells of the entire screen is initialized. During the address interval, the scan pulse and the data pulse are supplied to the first trigger electrode TY and the data electrode X respectively, and then the address discharge is caused between the first trigger electrode TY and the data electrode X such that a cell is selected. During the sustaining interval, pulses are alternately applied to each electrode of the pair of trigger electrodes TY and TZ, and at the same time, pulses are alternately applied to each electrode of the pair of sustaining electrodes Sy and Sz. At this moment, the trigger discharge between the pair of trigger electrodes TY and TZ occurs first, then a long path discharge occurs between the pair of sustaining electrodes SY and SZ by using the priming charged particles generated by the trigger discharge.

In the five-electrode PDP, it is necessary that a high sustaining voltage is applied to the pair of sustaining electrodes SY and SZ for effectively causing the long path discharge, i.e., the sustaining discharge. By the way, there can occurs a discharge between the data electrode X that sustains the ground level GND in the sustaining interval and at least one of the pair of sustaining electrodes SY and SZ when too high a voltage is applied to the pair of sustaining electrodes SY and SZ. In this case, the discharge path is dispersed to decrease the efficiency of the sustaining discharge, thereby deteriorating brightness.

Also, in the five-electrode PDP, it is desirable that a short path discharge between the pair of trigger electrodes TY and TZ should occur as small as possible for increasing the efficiency and brightness of the long path discharge between the pair of the sustaining electrodes SY and SZ. And yet, because a let of wall charges are formed on the first trigger electrode TY by the address discharge and the gap between the pair of trigger electrodes TY and TZ, it is likely that the short path discharge occurs intensely between the pair of trigger electrodes TV and TZ.

SUMMARY OF THE INVENTION

Accordingly, it is an object of the present invention to provide a plasma display panel that is capable of improving its discharge efficiency and brightness.

In order to achieve these and other objects of the invention, a plasma display panel according to one aspect of the present invention includes an upper electrode group formed on an upper substrate, including a scanning electrode to which a scanning voltage is supplied; barrier ribs formed on a lower substrate facing the upper substrate with a discharge space therebetween for dividing the discharge space; and an address electrode formed on the lower substrate to be located under the barrier ribs, and to which a data voltage is supplied.

The plasma display panel further includes an auxiliary address electrode extended from one side of the address electrode to the direction of the scanning electrode.

In the plasma display panel, the auxiliary address electrode overlaps with the scanning electrode and has the discharge space therebetween.

In the plasma display panel, a cell is selected by a discharge between the scanning electrode and the auxiliary address electrode of the address electrode.

In the plasma display panel, the upper electrode group includes a pair of trigger electrodes; and a pair of sustaining electrodes that has a wider gap therebetween than the pair of trigger electrodes and has the pair of trigger electrodes arranged therebetween.

A plasma display panel according to another aspect or the present invention includes an upper electrode group formed on an upper substrate, including a scanning electrode to which a scanning voltage is supplied; an address electrode formed on a lower substrate facing the upper substrate with a discharge space therebetween to cross with the upper electrode group perpendicularly; barrier ribs formed on the lower substrate for dividing the discharge space, and an auxiliary barrier rib extending toward the discharge space from at least one side of the barrier ribs.

In the plasma display panel, the auxiliary barrier ribs are respectively extended from both sides of the barrier ribs and are opposite to each other.

In the plasma display panel, the upper electrode group includes a pair of trigger electrodes; and a pair of sustaining electrodes that has a wider gap therebetween than the pair of trigger electrodes and has the pair of trigger electrodes arranged therebetween.

In the plasma display panel, the auxiliary barrier rib has the discharge space therebetween and overlaps with the pair of trigger electrodes.

In the plasma display panel, the auxiliary barrier rib overlaps with other electrode than the electrode to which a scanning voltage is supplied out of the pair of trigger electrodes, having a discharge space therebetween.

In the plasma display panel, the auxiliary barrier rib is extended to the direction of the width of the barrier ribs.

A plasma display panel according to another aspect of the present invention includes an upper electrode group formed on an upper substrate, including a scanning electrode to which a scanning voltage is supplied; and an address electrode formed on a lower substrate facing the upper substrate with a discharge space therebetween to cross with the upper electrode group perpendicularly, and wherein the width of at least one outer electrode that is located at the outer side among the upper electrode group is set to be wider than that of at, least one inner electrode that is located between the outer electrodes.

In the plasma display panel, the outer electrodes includes a first sustaining electrode to which the scanning electrode is supplied; and a second sustaining electrode separated from the first sustaining electrode with at least one inner electrode therebetween.

In the plasma display panel, the electrode width of the first and the second sustaining electrodes is set to be wider than that of at least one of the inner electrodes.

In the plasma display panel, the electrode width of the first sustaining electrode is set to be wider than that of at least one of the inner electrodes.

In the plasma display panel, the electrode width of the second sustaining electrode is set to be equal to that of at least one of the inner electrodes.

The plasma display panel further includes a dielectric layer formed on the upper substrate to cover the upper electrode group; a protective film deposited on the dielectric layer; barrier ribs formed on the lower substrate for dividing the discharge space; and a fluorescent material layer formed on the surface of the barrier ribs and the lower substrate.

BRIEF DESCRIPTION OF THE DRAWINGS

These and other objects of the invention will be apparent from the following detailed description of the embodiments of the present invention with reference to the accompanying drawings, in which.

DETAILED DESCRIPTION OF THE PREFERRED EMBODIMENTS

With reference to FIGS. 7 to 15, preferred embodiments of the present invention are particularly explained as followings.

Figure 1:
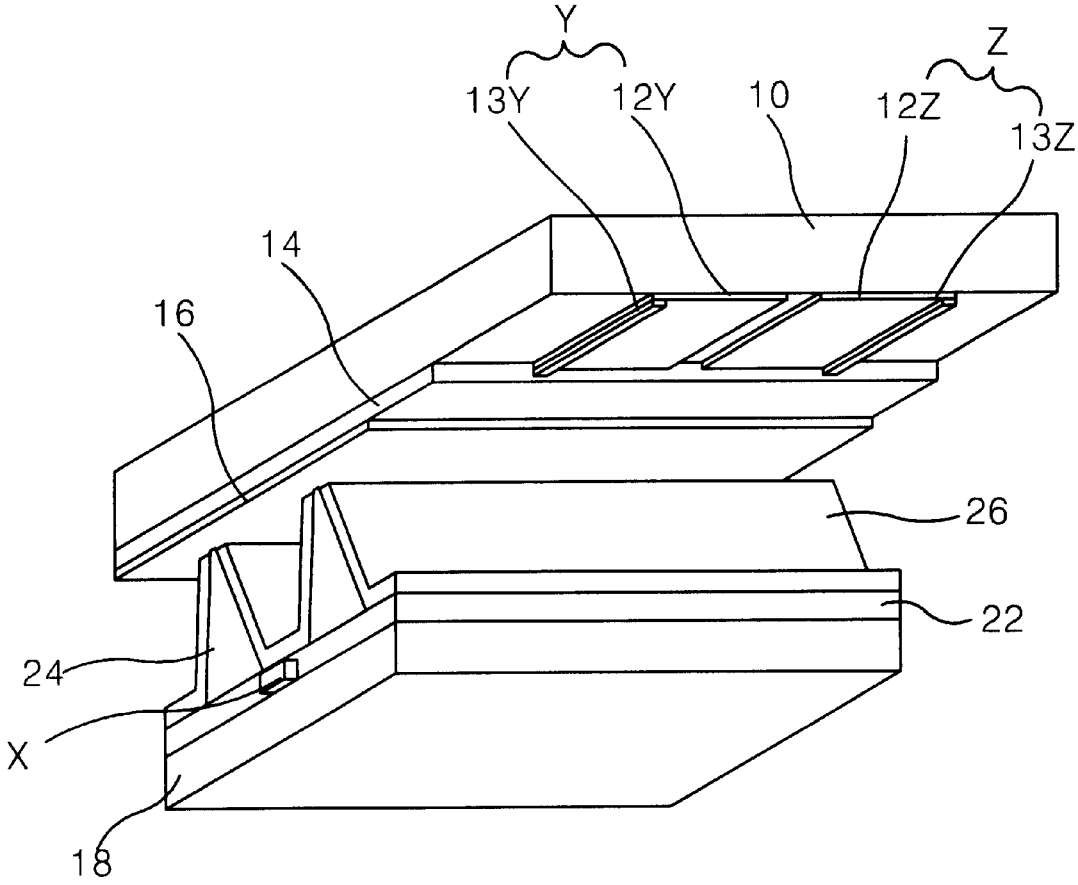
FIG. 1 is a perspective view showing a structure of a discharge cell of a conventional three-electrode plasma display panel.
Figure 2:
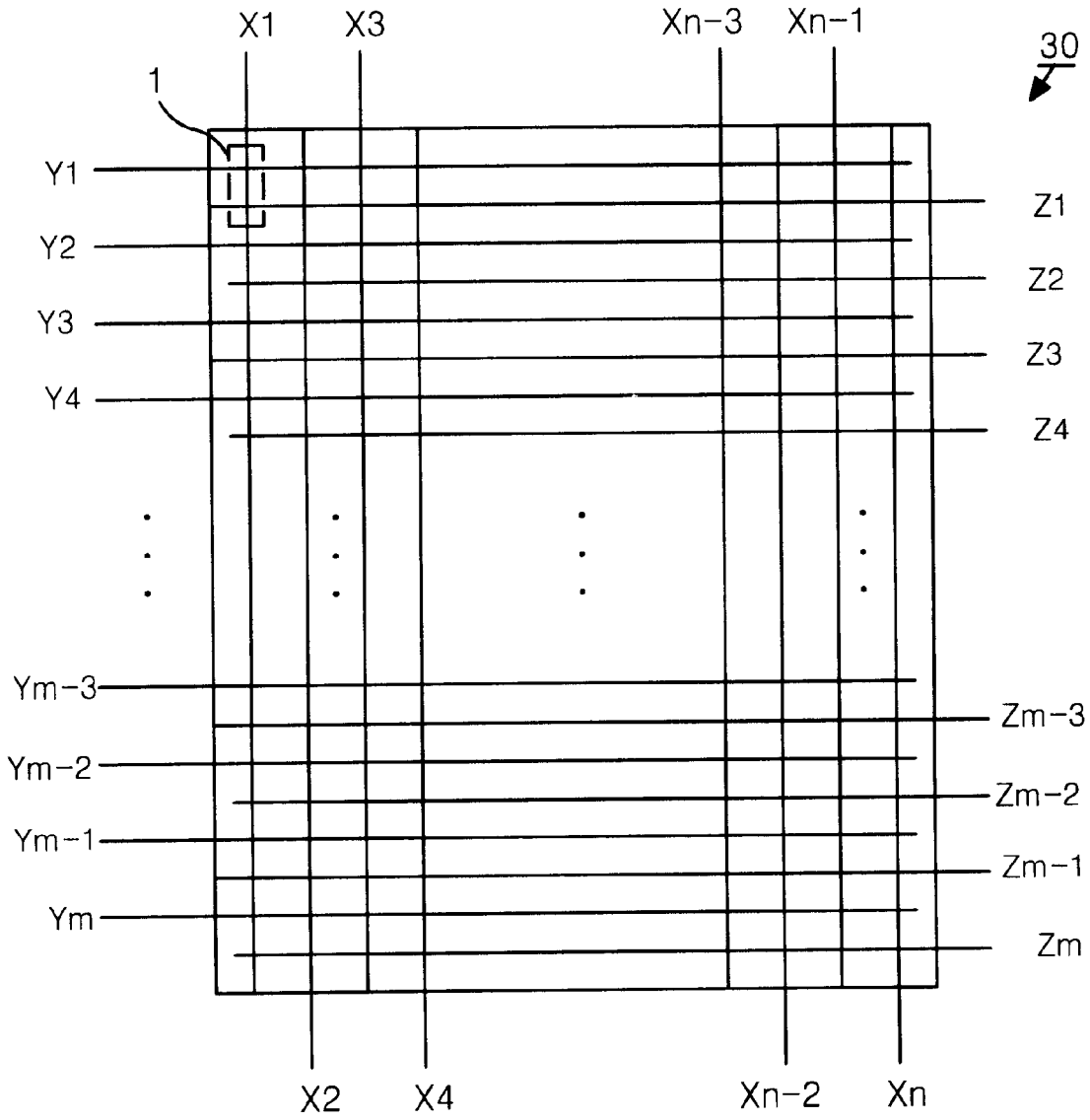
FIG. 2 is a plan view showing an electrode arrangement of the three-electrode plasma display panel.
Figure 3:
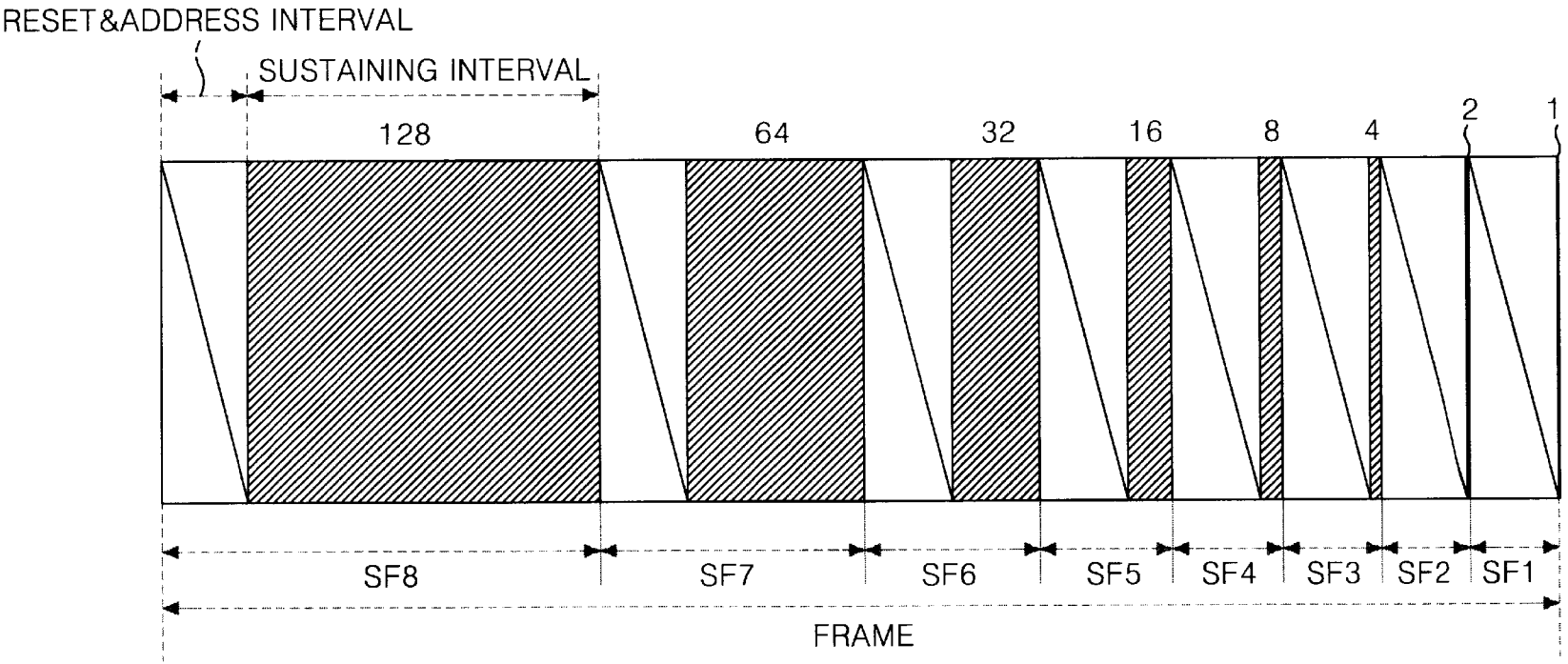
FIG. 3 depicts a configuration of one frame in the PDP.
Figure 4:
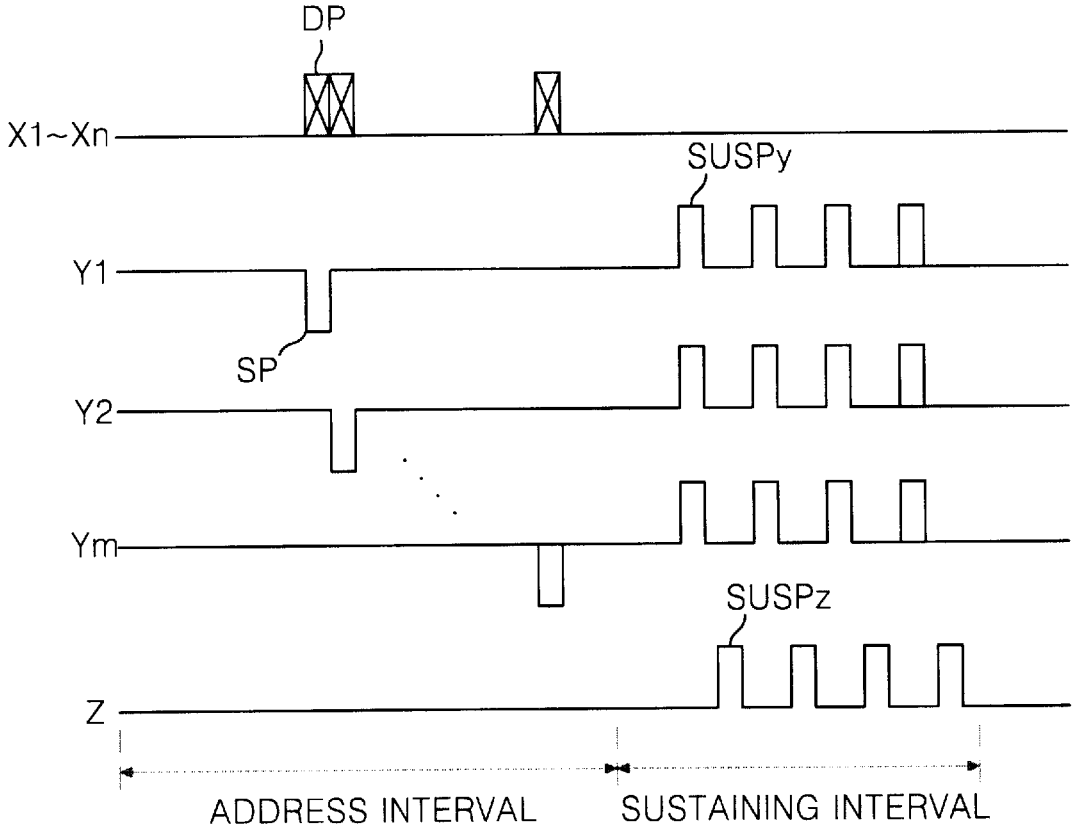
FIG. 4 is a waveform diagram of driving signals for the three-electrode plasma display panel shown.
Figure 5:
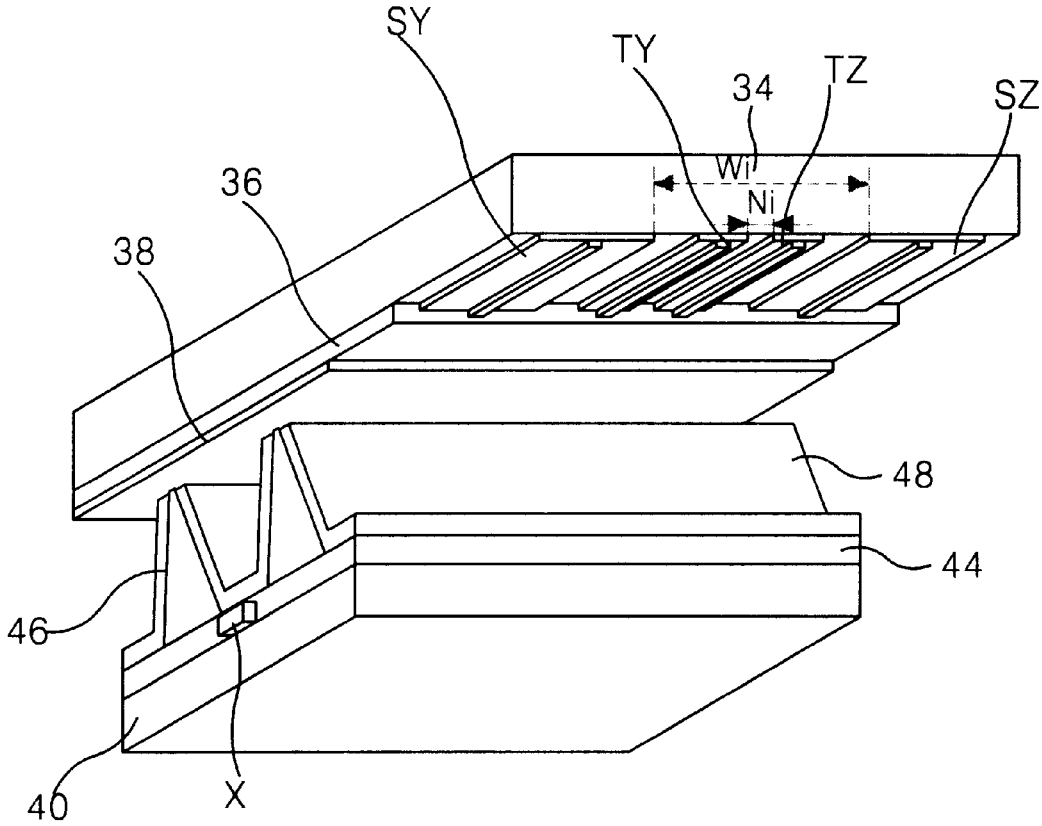
FIG. 5 is a perspective view showing a structure of a discharge cell of a conventional five-electrode plasma display panel.
Figure 6:
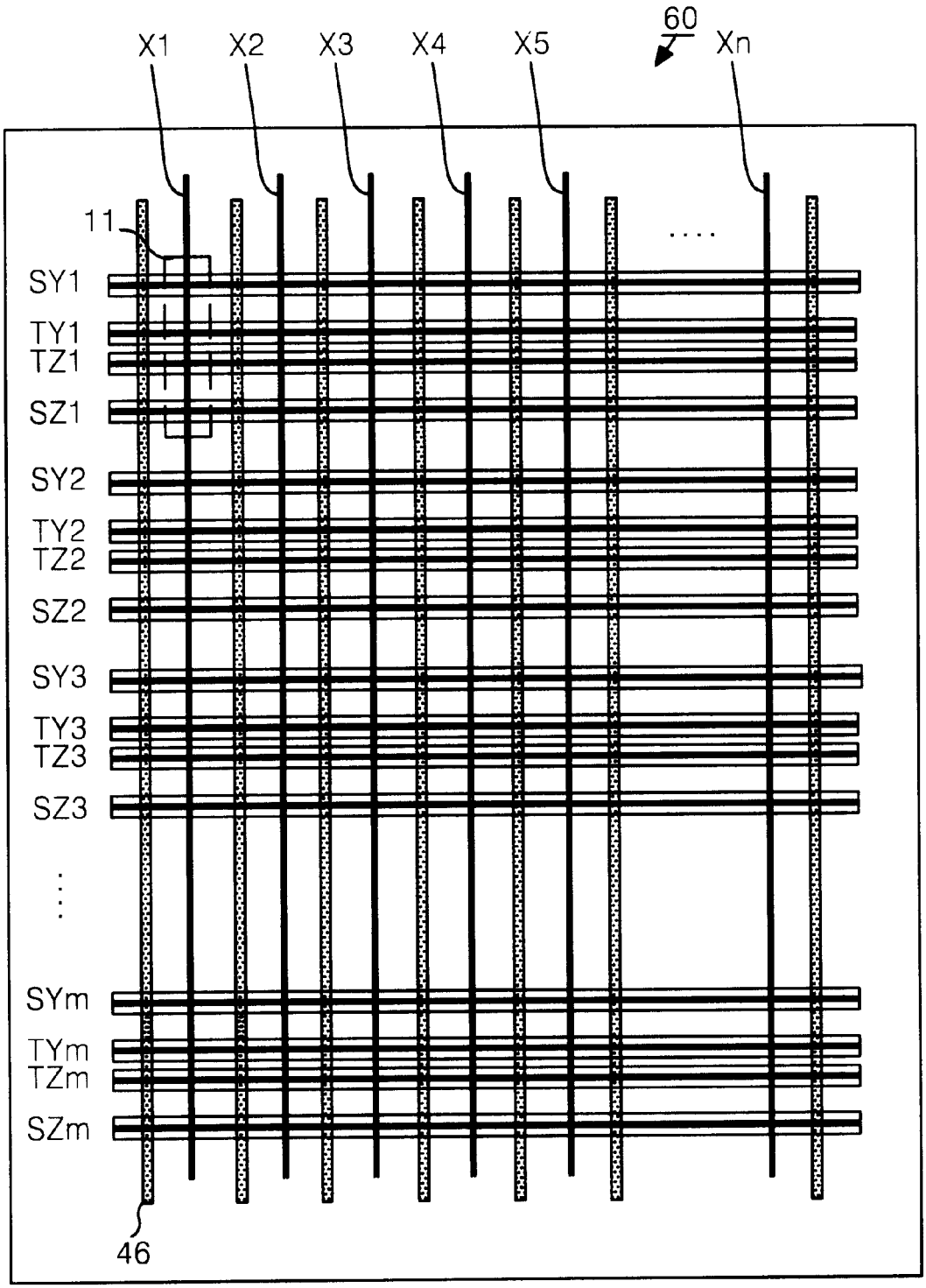
FIG. 6 is a plan view showing an electrode arrangement of the five-electrode plasma display panel.
Figure 7:
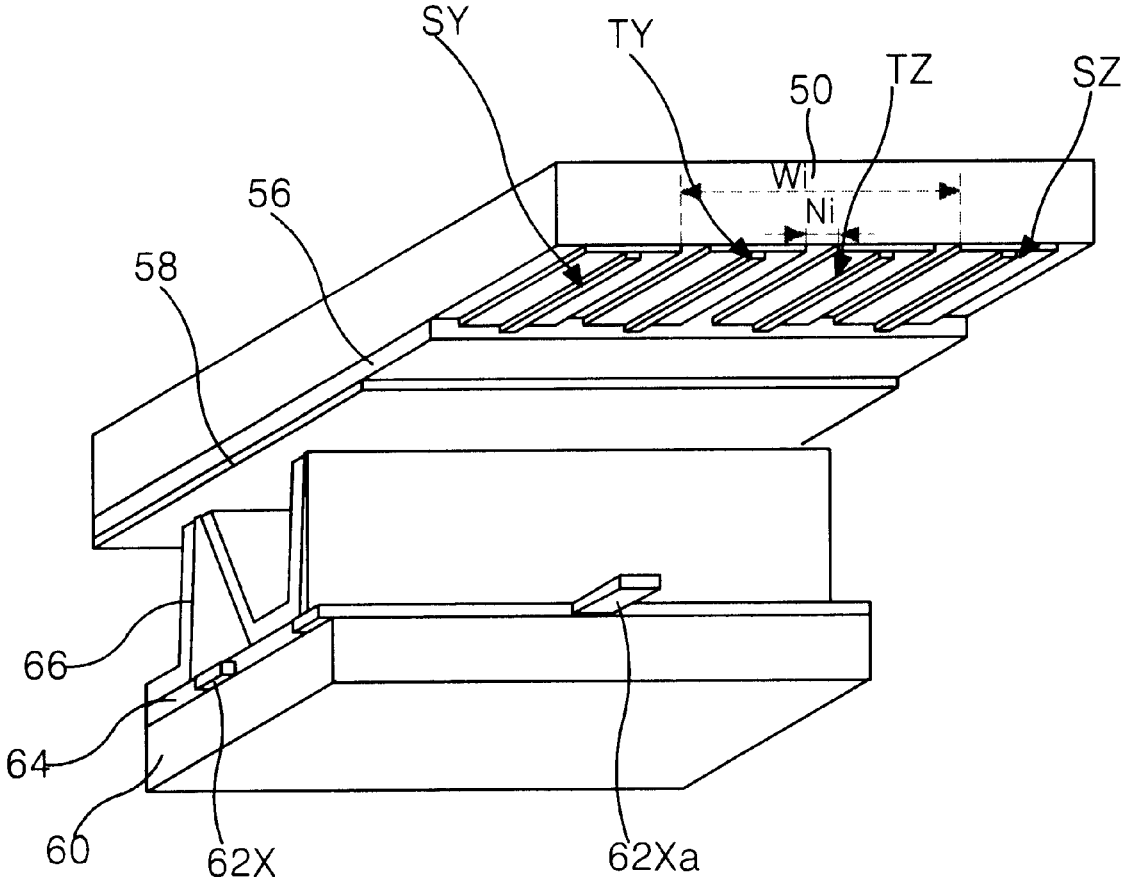
FIG. 7 is a perspective view showing a structure of a discharge cell of a plasma display panel with a part of barrier ribs eliminated according to a first embodiment of the present invention.
Figure 8:
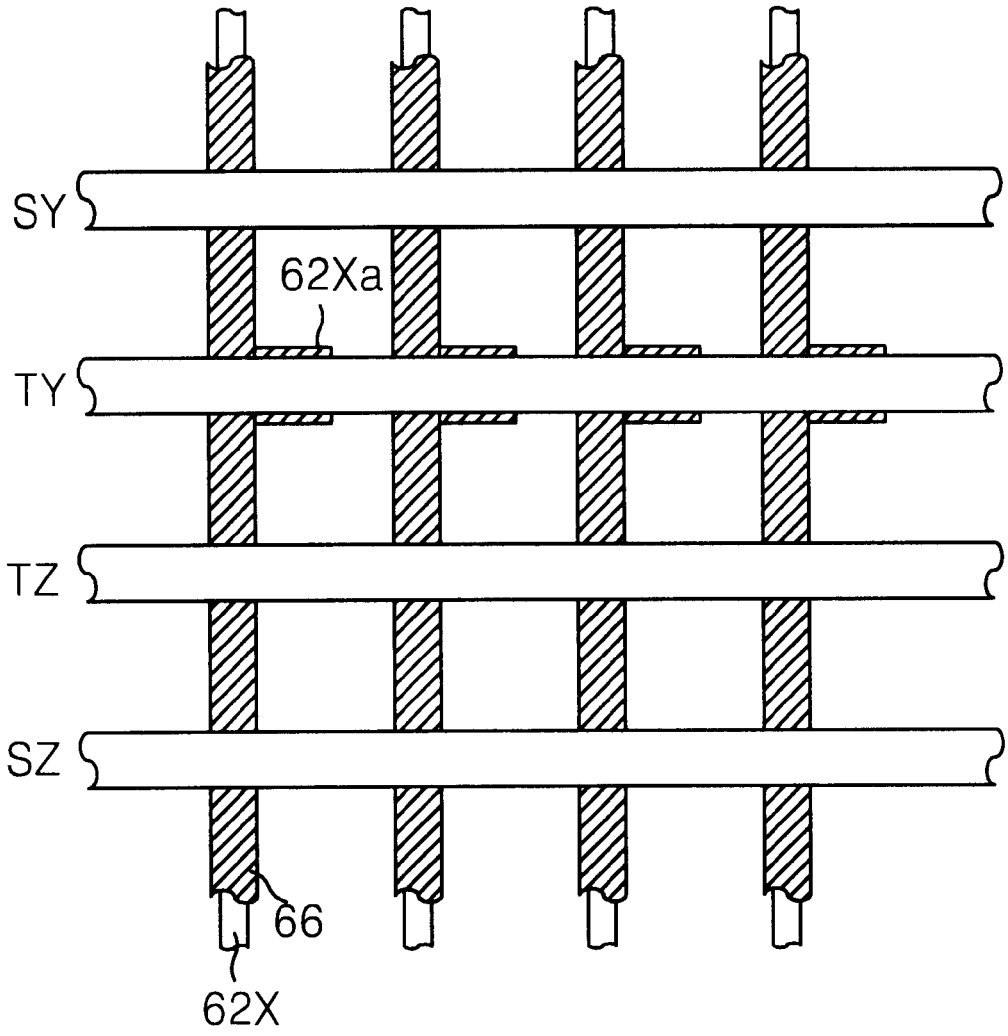
FIG. 8 is a plan view showing the discharge cell of the plasma display panel shown in FIG. 7.

Referring to FIGS. 7 and 8, a PDP according to a first embodiment of the present invention includes a pair of trigger electrodes TY and TZ formed on an upper substrate 50 to be located at the central part of a discharge cell; a pair of sustaining electrodes SY and SZ formed on the upper substrate 50 to be located at the edge art of the discharge cell having the pair of trigger electrodes TY and TZ therebetween; a data or address electrode 62X formed below barrier ribs of a lower substrate 60 to perpendicularly cross with the pair of trigger electrodes TY and TZ and the pair of sustaining electrodes SY and SZ, having an auxiliary address electrode 62Xa formed at its one side.

The pair of trigger electrodes TY and TZ and the pair of sustaining electrodes SY and SZ are formed in parallel on the upper substrate 50, each of which has a transparent electrode with a wide width and a metal bus electrode with a narrow width. The pair of trigger electrodes TY and TZ are set to have a narrow gap between them.

The pair of sustaining electrode SY and SZ have the pair of trigger electrodes TY and TZ located therebetween and their gap is set to be a wider than that of the pair of trigger electrodes TY and TZ. The pair of sustaining electrode SY and SZ causes a long path discharge by using space charges and wall charges formed by a discharge between the pair of trigger electrodes TY and TZ.

An upper dielectric layer 56 and a protective film 58 are disposed on the upper substrate 50 in such a manner to cover the pair of trigger electrodes TY and TZ and the pair of sustaining electrode SY and SZ. The wall charges generated upon plasma discharge are accumulated in the upper dielectric layer 56. The protective film 58 prevents a damage of the upper dielectric layer 56 caused by a sputtering during the plasma discharge and improves the emission efficiency of secondary electrons.

A lower dielectric layer 64 and barrier ribs 66 are Formed on the lower substrate 60. The surfaces of the lower dielectric layer 64 and the barrier ribs 66 are coated with a fluorescent material layer 68. The barrier ribs 66 separate adjacent discharge spaces in the horizontal direction to thereby prevent optical and electrical crosstalk between adjacent discharge cells. The fluorescent material layer 68 is excited by an ultraviolet ray generated during the plasma discharge to generate any one of red, green and blue visible light rays.

The auxiliary address electrode 62Xa of the address electrode 62X is extended from one side of the address electrode 62X in the direction parallel to the pair of trigger electrodes TY and TZ and the pair of sustaining electrodes SY and SZ, and perpendicularly overlaps with the first trigger electrode TY playing a role of a scanning electrode while having the discharge space of the discharge cell therebetween.

An inactive mixture gas of He+Xe, Ne+Xe or He+Xe+Ne is injected into the discharge space defined between the upper and lower substrate 50 and 60 and the barrier rib 66.

A PDP according to a first embodiment of the present invention drives one frame, which is divided into various sub-Fields with a different discharge frequency, so as to realize gray levels of a picture. Each sub-field is again divided into a reset interval for uniformly causing the discharge, an address interval For selecting a discharge cell and a sustaining interval for realizing the gray level in accordance with a discharge frequency.

Herein, the reset interval and the address interval are the same in each sub-field, whereas the sustaining interval has its light-emission frequency and its interval set different from one another in accordance with the weighted value of brightness. In the reset interval, the discharge cells of an entire screen are initialized.

In the address interval, a scanning pulse and a data pulse are supplied to the first trigger electrode TY and the address electrode 62X respectively. At his moment, an address discharge occurs within the discharge cell to which data is supplied b a voltage difference between the first trigger electrode TY and the auxiliary address electrode 62Xa of the address electrode 62X.

In the sustaining interval, a pulse is alternately applied to each of the pair of trigger electrodes TY and TZ, and at the same time, a pulse is alternately applied to each of the pair of sustaining electrodes SY and SZ. AP this moment, a trigger discharge between the pair of trigger electrodes TY and TZ occurs first, then a long path discharge occurs between the pair of sustaining electrodes SY and SZ by using the priming charged particles generated by the trigger discharge.

In the PDP as in FIGS. 7 and 8, because most address electrode 62X is located below the barrier ribs 66 except the auxiliary address electrode 62Xa, the wall charges generated upon the address discharge are concentrically accumulated on the first trigger electrode TY and the auxiliary address electrode 62Xa of the address electrode 62X. Thereby, the influence of the address electrode 62Xa is minimized to make the long path discharge between the pair of sustaining electrodes SY and SZ occur with a high efficiency.

In other words, heretofore by the influence of the wall charges accumulated on the address electrode 62X upon the long path discharge between the pair or sustaining electrodes SY and SZ, the efficiency and brightness of the long path discharge are deteriorated by the discharge between the address electrode 62X and at least one of the pair of sustaining electrodes SY and SZ.

On the contrary, in the PDP as in FIGS. 7 and 8, because the address discharge occurs only between the first trigger electrode TY and the auxiliary address electrode 62Xa formed at one side on the address electrode 62X, the influence of the wall charges formed on the address electrode 62X is minimized upon the long path discharge between the lair of sustaining electrodes SY and SZ. Also, because the overlapping area between the auxiliary address electrode 62Xa of the address electrode 62X and the trigger electrode TY overlapped having a discharge space therebetween can be formed to be broader than before, the address discharge can occur stably.

Figure 9:
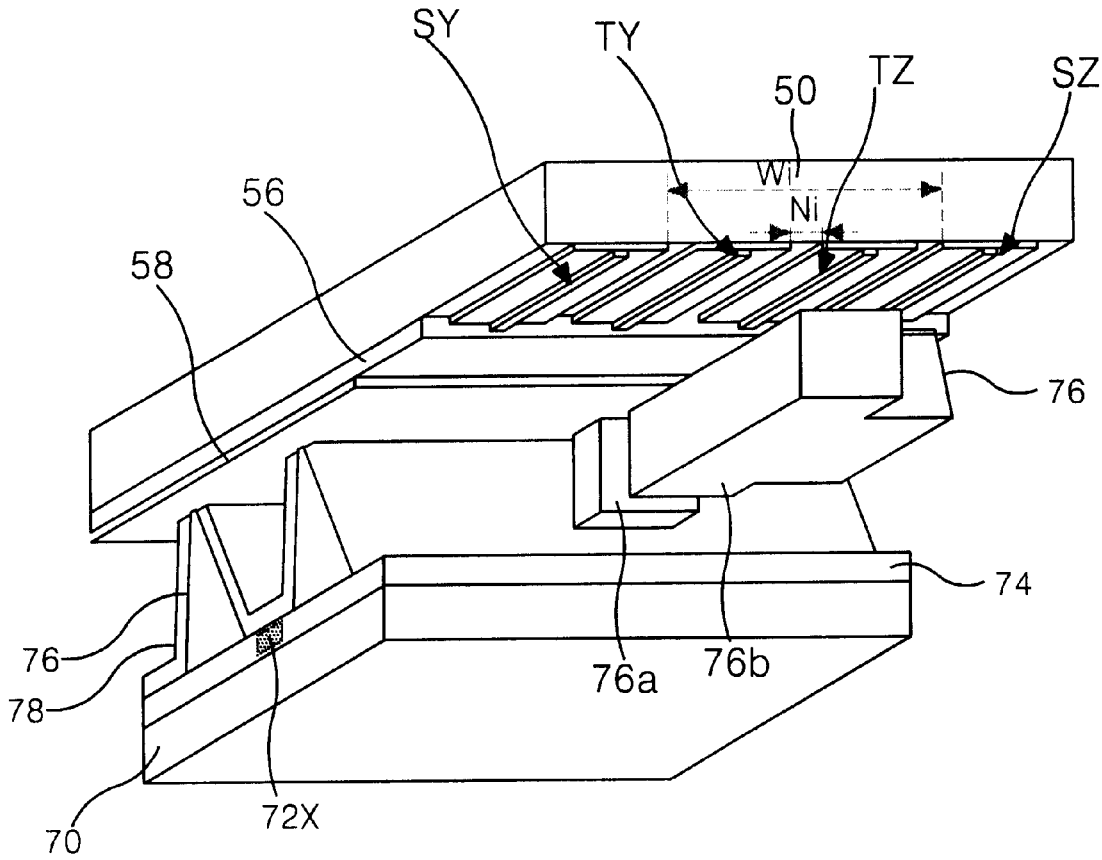
FIG. 9 is a perspective view showing a structure of a discharge cell of a plasma display panel according to a second embodiment of the present invention.
Figure 10:
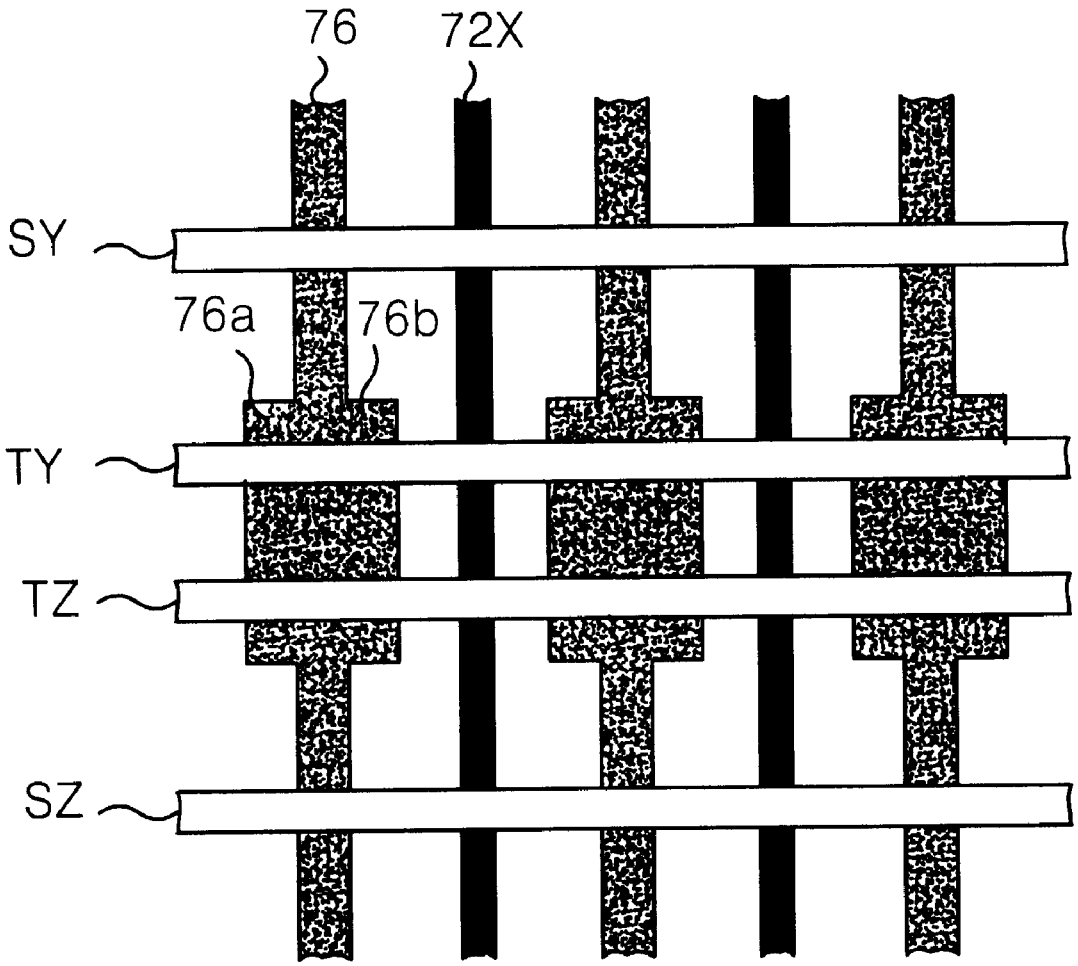
FIG. 10 is a plan view showing the discharge cell of the plasma display panel shown in FIG. 9.

FIGS. 9 and 10 represent a PDP according to a second embodiment of the present invention.

In FIGS. 9 and 10, the same numbering will be given and detail explanation will be omitted with regard to an upper plate equal to the upper plate of the PDP shown in FIGS. 7 and 8.

Regarding to FIGS. 9 and 10, a lower plate of the PDP according to the second embodiment of the present invention includes auxiliary barrier ribs 76*a* and 76*b* extended from both sides of barrier ribs 76 that are located below the pair of trigger electrodes TY and TZ.

The pair of trigger electrodes TY and TZ and the pair of sustaining electrodes SY and SZ are formed on the upper substrate 50 perpendicularly crossing with the address electrode 72X of the lower substrate 70.

The barrier ribs 76 where the auxiliary barrier ribs 76*a* and 76*b* separate adjacent discharge spaces in the horizontal direction to thereby prevent optical and electrical crosstalk between adjacent discharge cells. The fluorescent material layer 78 is formed on the surface of the lower dielectric layer 74 and the barrier ribs 76.

The auxiliary barrier ribs 76*a* and 76*b* are perpendicularly overlapped with the pair of trigger electrodes TY of the upper substrate 50 having the discharge space of the discharge cell therebetween. The auxiliary barrier ribs 76*a* and 76*b* are respectively projected toward the discharge space to play a role of physically narrowing the short path discharge space between the pair of trigger electrodes TY and TZ. The cross section of the discharge space of the discharge cell becomes 'I' shape, as in FIG. 10, by the auxiliary barrier ribs 76*a* and 76*b*. Therefore, the discharge space of the upper and lower part of the discharge cell is broader than that of the central part of the discharge cell where the auxiliary barrier ribs 76*a* and 76*b* are located.

An inactive mixture gas of He+Xe, Ne+Xe or He+Xe+Ne is injected into the discharge space defined between the upper and lower substrate 50 and 70 and the barrier rib 76.

The PDP drives one frame, which is divided into various sub-fields with a different discharge frequency, so as to realize gray levels of a picture. Each sub-field is again divided into a reset interval for uniformly causing the discharge, an address interval for selecting a discharge cell and a sustaining interval for realizing the gray level in accordance with a discharge frequency.

Herein, the reset interval and the address interval are the same in each sub-field, whereas the sustaining interval has its light-emission frequency and its interval set different from one another in accordance with the weighted value of brightness In the reset interval, the discharge cells of an entire screen are initialized.

In the address interval, a scanning pulse and a data pulse are supplied to the first trigger electrode TY and the data electrode 72X respectively. At this moment, an address discharge occurs within the discharge cell to which data is supplied by a voltage difference between the first trigger electrode TY and the address electrode 72X.

In the sustaining interval, a pulse is alternately applied to each of the pair of trigger electrodes TY and TZ, and at the same time, a pulse is alternately applied to each of the pair of sustaining electrodes SY and SZ. AT this moment, a trigger discharge between the pair of trigger electrodes TY and TZ occurs first, then a long path discharge occurs between the pair of sustaining electrodes SY and SZ by using the priming charged particles generated by the trigger discharge.

In the PDP as in FIGS. 9 and 10, because the short path discharge space between the pair of trigger electrodes TY and TZ is limited to be small by the auxiliary barrier ribs 76*a* and 76*b,* the short path discharge between the pair of trigger electrodes TY and TZ occurs weakly. Whereas, the long path discharge between the pair of sustaining electrodes SY and SZ occurs strongly with high efficiency because the discharge between the pair of the trigger electrodes TY and TZ occurs weakly FIG. 11 represent a PDP according to a third embodiment of the present invention.

Figure 11:
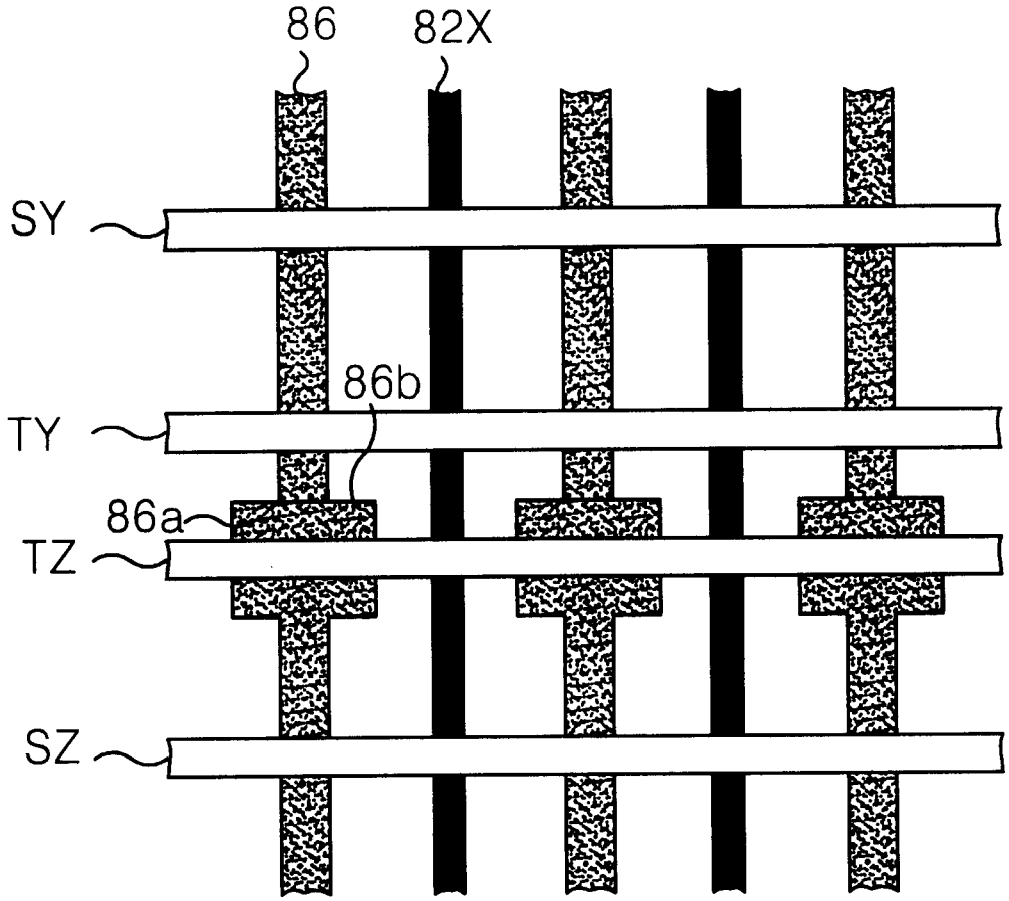
FIG. 11 is a plan view showing a discharge cell of a plasma display panel according to a third embodiment of the present invention.

Referring to FIG. 11, a lower plate of the PDP according to the third embodiment or the present invention includes auxiliary barrier ribs 86*a* and 86*b* extended from both sides of barrier ribs 86 that are located only below one electrode of the pair of trigger electrodes TY and TZ.

The PDP has the width and position of its auxiliary barrier ribs set different from the PDP shown in FIGS. 9 and 10. Because the PDP shown in FIGS. 9 and 10 also has the auxiliary barrier ribs formed under the first trigger electrode TY that acts as a scanning electrode, the address discharge space is limited to make the address discharge unstable. On the contrary, Because the PDP shown in FIG. 11 does not have the auxiliary barrier ribs 86*a* and 86*b* formed under the first trigger electrode TY that acts as the scanning electrode, the address discharge space is obtained as much. Thereby, the address discharge occurs in bigger scale and enough amount of wall charges can be used in the sustaining discharge.

On the other hand, in the PDP according to the second and the third embodiment of the present invention, the area where the fluorescent material is spread is increased as much by the auxiliary barrier ribs 76*a,* 76*b,* 86*a* and 86*b* of the barrier ribs 76 and 86, thereby increasing the brightness.

Figure 12:
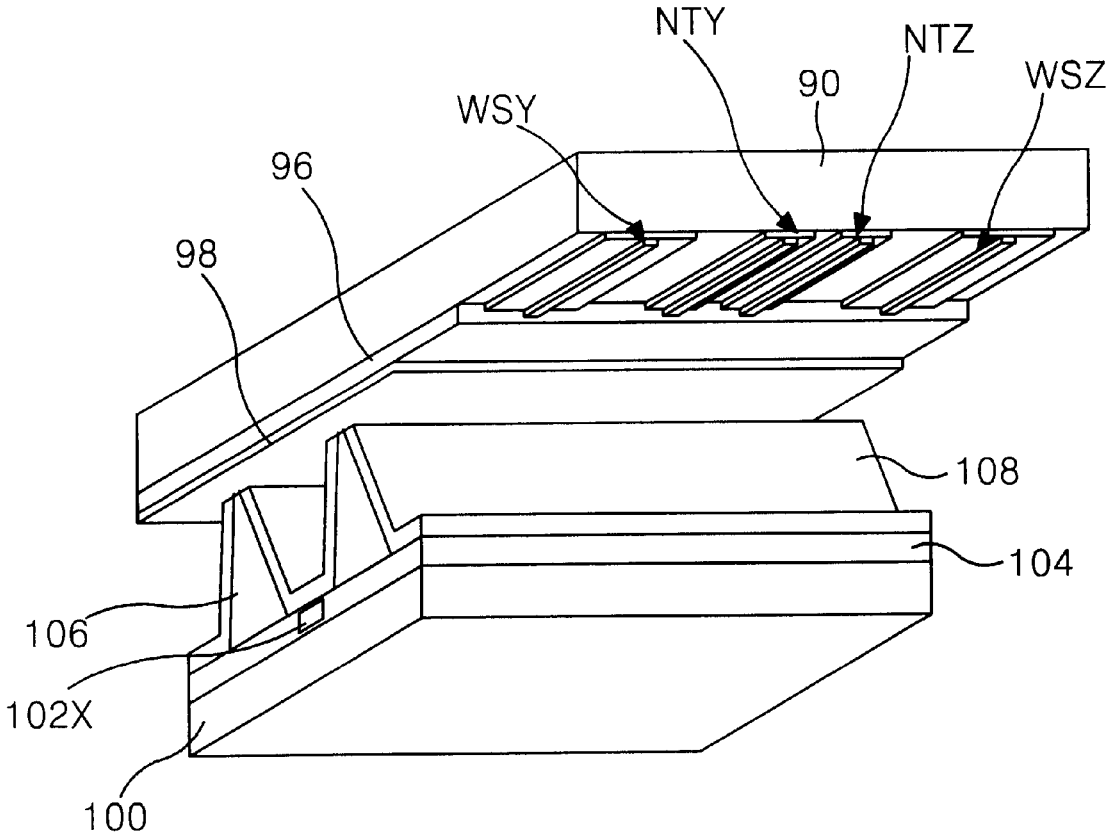
FIG. 12 is a perspective view showing a structure of a discharge cell of a plasma display panel according to a fourth embodiment of the present invention.
Figure 13:
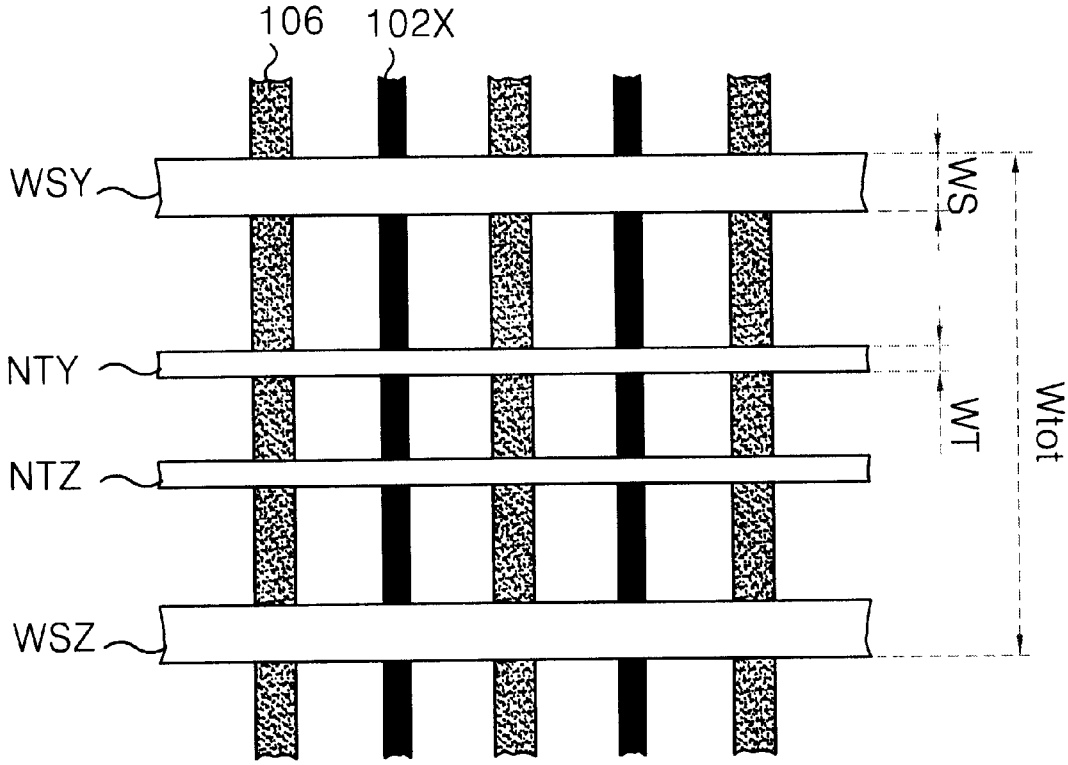
FIG. 13 is a plan view showing the plasma display panel shown in FIG. 12.

FIGS. 12 and 13 represents a PDP according to a fourth embodiment of the present invention.

Referring to FIGS. 12 and 13, the PDP according to the fourth embodiment of the present invention includes a pair of trigger electrodes NTY and NTZ formed on a upper substrate 90 to be located at the central part of a discharge cell; a pair of sustaining electrodes WSY and WSZ formed on the upper substrate 90 to be located at the edge part of the discharge cell, having the pair of trigger electrodes NTY and NTZ therebetween and having the width of each electrode set to be wider than that of the pair of trigger electrodes NTY and NTZ; a data electrode 102X formed on a lower substrate 100 to perpendicularly cross with the pair of trigger electrodes NTY and NTZ and the pair of sustaining electrodes WSY and WSZ.

The pair of trigger electrodes NTY and NTZ and the pair of sustaining electrodes WSY and WSZ are formed in parallel on the upper substrate 90, each of which has a transparent electrode with a wide width and a metal bus electrode with a narrow width. The pair of trigger electrodes NTY and NTZ are set to have a narrow gap between then.

The pair of sustaining electrode WSY and WSZ have the pair of trigger electrodes NTY and NTZ located therebetween and their gap is set to be a wider than that of the pair of trigger electrodes NTY and NTZ. The pair of sustaining electrode WSY and WSZ causes a long path discharge by using space charges and wall charges formed by a discharge between the pair of trigger electrodes NTY and NTZ.

Each electrode width WS of the pair of sustaining electrodes WSY and WSZ is set to be wider than that WT of the pair of trigger electrodes NTY and NTZ. Due to this, even though the sane voltage is applied to the pair of sustaining electrodes WSY and WSZ and the pair of trigger electrodes NTY and NTZ, much higher voltage can be applied to the pair of sustaining electrodes WSY and WSZ than to the pair of trigger electrodes NTY and NTZ, and much more amount of wall charges can be accumulated at the pair of sustaining electrode WSY and WSZ.

On the other hand, the total width Wtot of an upper electrode group including all the pair of trigger electrodes NTY and NTZ, the pair, of sustaining electrodes WSY and WSZ, and the gap therebetween can be set to be equal to or wider than that of the conventional five-electrode.

An upper dielectric layer 96 and a protective film 98 are disposed on the upper substrate 90 where the pair of trigger electrodes NTY and NTZ and the pair of sustaining electrodes WSY and WSZ, in such a manner to cover the pair of trigger electrodes NTY and NTZ and the pair of sustaining electrode WSY and WSZ.

A lower dielectric layer 104 and barrier ribs 106 are formed on the lower substrate 100. The surfaces of the lower dielectric layer 104 and the barrier ribs 106 are coated with a fluorescent material layer 108.

An inactive mixture gas of He+Xe, Ne+Xe or He+Xe+Ne is injected into the discharge space defined between the upper and lower substrate 90 and 100 and the barrier rib 106.

The PDP drives one frame, which is divided into various sub-fields with a different discharge frequency, so as to realize gray levels of a picture. Each sub-field is again divided into a reset interval for uniformly causing the discharge, an address interval for selecting a discharge cell and a sustaining interval for realizing the gray level in accordance with a discharge frequency.

Herein, the reset interval and the address interval are the same in each sub-field, whereas the sustaining interval has its light-emission frequency and its interval set different from one another in accordance with the weighted value of brightness. In the reset interval, the discharge cells of an entire screen are initialized.

In the address interval, a scanning pulse and a data pulse are supplied to the first trigger electrode NTY and the data electrode 102X respectively. At this moment, an address discharge occurs within the discharge cell to which data is supplied by a voltage difference between the first trigger electrode NTY and the address electrode 102X.

In the sustaining interval, a pulse is alternately applied to each of the pair of trigger electrodes NTY and NTZ, and at the same time, a pulse is alternately applied to each of the pair of sustaining electrodes WSY and WSZ. AT this moment, a trigger discharge between the pair of trigger electrodes NTY and NTZ occurs first, then a long path discharge occurs between the pair of sustaining electrodes WSY and WSZ by using the pruning charged particles generated by the trigger discharge.

Herein, because the width of each electrode included in the pair of sustaining electrodes WSY and WSZ is set to be wider than that of the pair of trigger electrodes NTY and NTZ, the long path discharge between the pair of sustaining electrodes WSY and WSZ occurs more strongly than the short path discharge of the pair of trigger electrodes NTY and NTZ. In other words, the long path discharge between the pair of sustaining electrode occurs dominantly in the sustaining interval.

Figure 14:
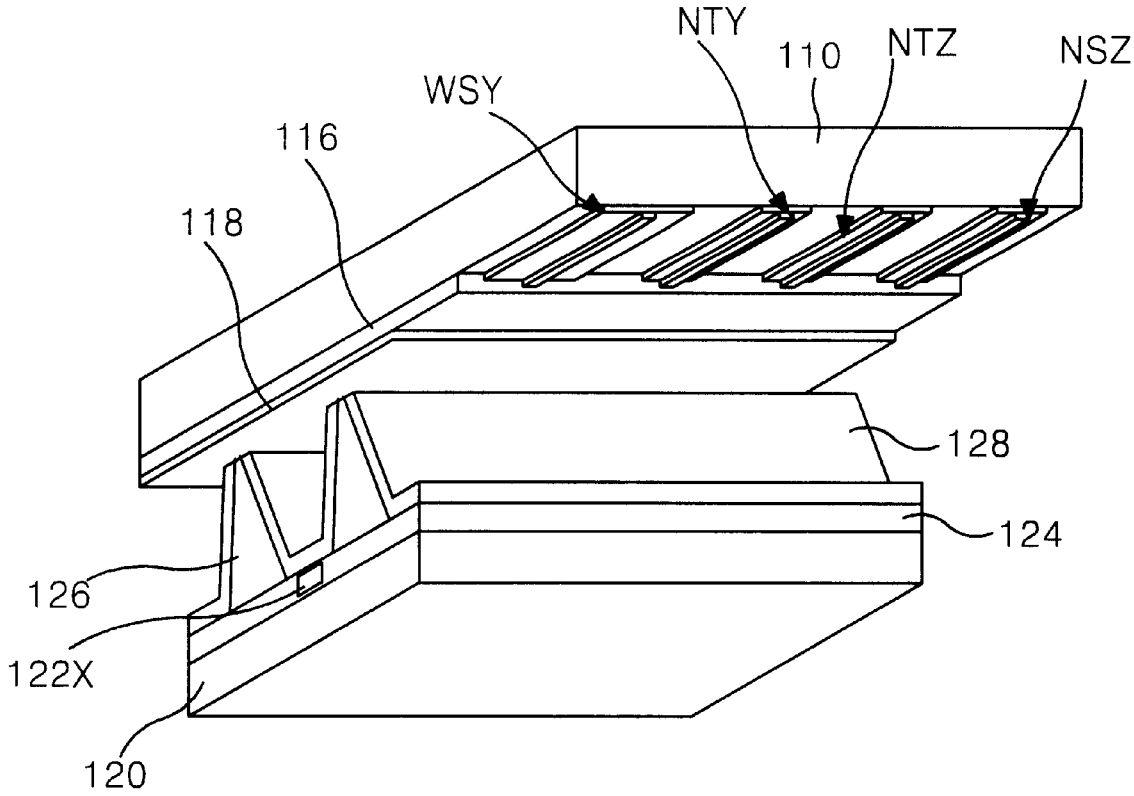
FIG. 14 is a perspective view showing a structure of a discharge cell of a plasma display panel according to a fifth embodiment of the present invention.
Figure 15:
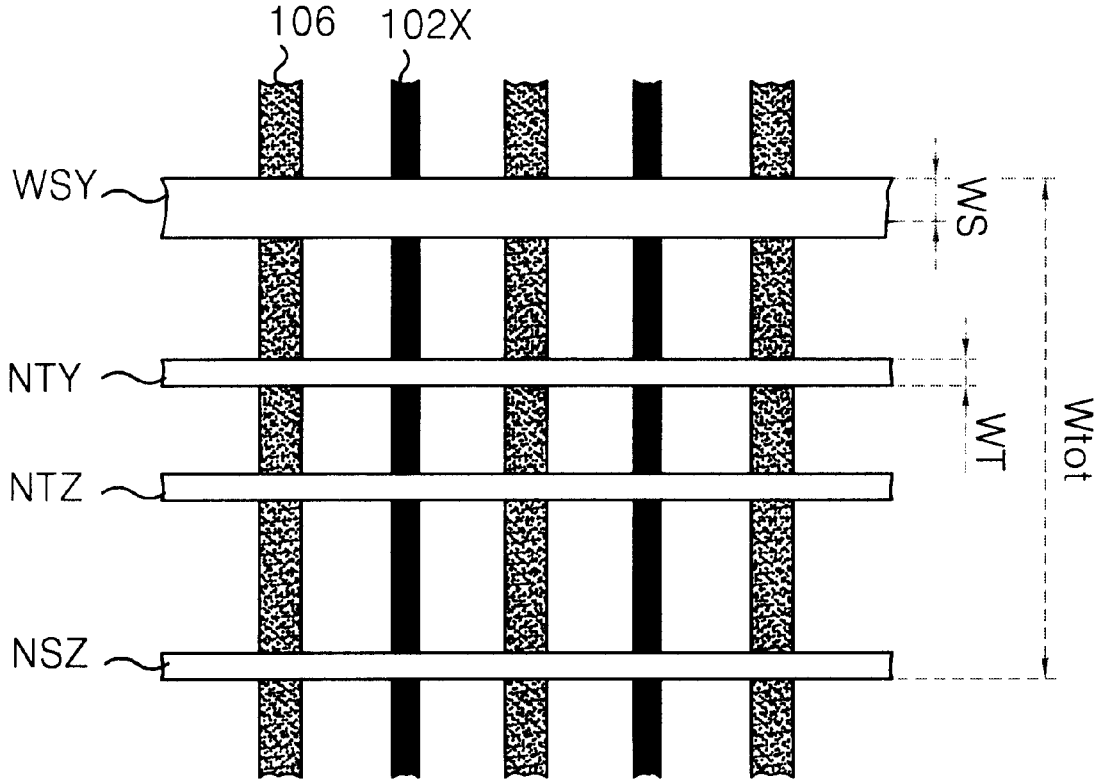
FIG. 15 is a plan view showing the plasma display panel shown in FIG. 14.

FIGS. 14 and 15 represents a PDP according to a fifth embodiment of the present invention.

Referring to FIGS. 14 and 15, the PDP according to the fifth embodiment of the present invention includes a pair of trigger electrodes NTY and NTZ formed on a upper substrate 110 to be located at the central part of a discharge cell;

a pair of sustaining electrodes WSY and NSZ formed on the upper substrate 110 to be located at the edge part of the discharge cell, having the pair of trigger electrodes NTY and NTZ therebetween and having the width of each electrode set to be wider than that of the pair of trigger electrodes NTY and NTZ; a data electrode 122X formed on lower substrate 120 to perpendicularly cross with the pair of trigger electrodes NTY and NTZ and the pair of sustaining electrodes WSY and NSZ.

The pair of trigger electrodes NTY and NTZ and the pair of sustaining electrodes WSY and NSZ are formed in parallel on the upper substrate 110, each of which has a transparent electrode with a wide width and a metal bus electrode with a narrow width. The pair of trigger electrodes NTY and NTZ are set to have a narrow gap between them.

The pair of sustaining electrodes WSY and NSZ have the pair of trigger electrodes NTY and NTZ located therebetween and their gap is set to be a wider than that of the pair of trigger electrodes NTY and NTZ. The pair of sustaining electrodes WSY and NSZ causes a long path discharge by using space charges and wall charges formed by a discharge between the pair of trigger electrodes NTY and NTZ.

The width Ws of the first sustaining electrode WSY that acts as the scanning electrode among the pain of sustaining electrodes WSY and NSZ is set to be wider than that Wt of the second sustaining electrode NSZ. Because the first sustaining electrode WSY has a wider electrode width than the conventional five-electrode PDP due to this, the long path discharge between the pair of sustaining electrodes occurs more dominantly than the discharge between the pair or trigger electrodes NTY and NTZ, as well as much more wail charges are accumulated upon the address discharge.

Also, because the width of the first sustaining electrode WSY is set to be wide and the width or the second sustaining electrode NSZ is set to be narrow relatively, the increase of its power consumption resulted from its electric current increase can be suppressed by minimizing the increment portion of an electrode area than the conventional five-electrode PDP.

Therefore, in the PDP according to the fifth embodiment of the present invention, only the electrode width of one of the pair of sustaining electrodes WSY and NSZ is increased to make the long path discharge occur dominantly upon the sustaining discharge and the electric current increase suppressed to the highest degree, thereby minimizing the increment portion of the power consumption.

On the other hand, the total width Wtot of an upper electrode group including all the pair of trigger electrodes NTY and NTZ, the pair of sustaining electrodes WSY and NSZ, and the gap therebetween can be set to be equal to or wider than that of the conventional five-electrode.

An upper dielectric layer 116 and a protective film 118 are disposed on the upper substrate 110 where the pair of trigger electrodes NTY and NTZ and the pair of sustaining electrodes WSY and NSZ, in such a manner to cover the pair of trigger electrodes NTY and NTZ and the pair of sustaining electrodes WSY and NSZ.

A lower dielectric layer 124 and barrier ribs 125 are formed on the lower substrate 120. The surfaces of the lower dielectric layer 124 and the barrier ribs 126 are coated with a fluorescent material layer 128

An inactive mixture gas of He+Xe, Ne+Xe or He+Xe+Ne is injected into the discharge space defined between the upper and lower substrate 110 and 120 and the barrier rib 126.

As described above, the PDP according to the present invention locates the address electrode below the barrier ribs and has the auxiliary address electrode formed at one side of the address electrode in the overlapping position with the scanning electrode, thereby minimizing the influence of the address electrode. Or it has the auxiliary barrier ribs formed at both side of the barrier ribs, thereby physically reducing the discharge between the pair of trigger electrodes, Also, the PDP according to this invention has the width of the sustaining electrode wider than the trigger electrode, thereby causing the long path discharge between the pair of sustaining electrodes occur more dominantly than the short path discharge between the pair of trigger electrodes upon the sustaining discharge. As a result, the PDP of this invention has the discharge between the pair of sustaining electrodes occur strongly with a high efficiency, thereby increasing the discharge efficiency and brightness.

It should be understood to the ordinary skilled person in the art that the invention is not limited to the embodiments, but rather that various changes or modifications thereof are possible without departing from the spirit of the intention. Accordingly, the scope of the invention shall be determined only by the appended claims and their equivalents.

What is claimed is:

1. A plasma display panel, comprising:

an upper electrode group formed on an upper substrate, including a scanning electrode to which a scanning voltage is supplied;

barrier ribs formed on a lower substrate facing the upper substrate with a discharge space therebetween for dividing the discharge space;

an address electrode formed on the lower subs ate to be located under the barrier ribs, and to which a data voltage is supplied; and an auxiliary address electrode extended from one side of the address electrode in a direction of the scanning electrode.

2. The plasma display panel according to claim 1, wherein the auxiliary address electrode overlaps with the scanning electrode and has the discharge space therebetween.

3. The plasma display panel according to claim 1, wherein a cell is selected by a discharge between the scanning electrode and the auxiliary address electrode of the address electrode.

4. The plasma display panel according to claim 1, wherein the upper electrode group includes:

a pair of trigger electrodes; and a pair of sustaining electrodes that has a wider gap therebetween than the pair of trigger electrodes and has the pair of trigger electrodes arranged therebetween.

5. A plasma display panel, comprising:

an upper electrode group formed on an upper substrate, including a scanning electrode to which a scanning voltage is supplied;

an address electrode formed on a lower substrate facing the upper substrate with a discharge space therebetween to cross with the upper electrode group perpendicularly;

barrier ribs formed on the lower substrate for dividing the discharge space; and an auxiliary barrier rib extending toward the discharge space from at least one side of the barrier ribs.

6. The plasma display panel according to claim 5, wherein the auxiliary barrier rib comprises at least two barrier ribs respectively extended from both sides of the barrier ribs and opposite to each other.

7. The plasma display panel according to claim 5, wherein the upper electrode group includes:

a pair of trigger electrodes; and a pair of sustaining electrodes that has a wider gap therebetween than the pair of trigger electrodes and has the pair of trigger electrodes arranged therebetween.

8. The plasma display panel according to claim 7, wherein the auxiliary barrier rib has the discharge space therebetween and overlaps with the pair of trigger electrodes.

9. The plasma display panel according to claim 7, wherein the auxiliary barrier rib overlaps with an electrode other than the electrode to which a scanning voltage is supplied out of the pair of trigger electrodes, having a discharge space therebetween.

10. The plasma display panel according to claim 5, wherein the auxiliary barrier rib is extended in a direction of a width of the barrier ribs.

11. A plasma display panel, comprising:

an upper electrode group formed on an upper substrate, including a scanning electrode to which a scanning voltage is supplied; and an address electrode formed on a lower substrate facing the upper substrate with a discharge space therebetween to cross with the upper electrode group perpendicularly, wherein a width of at least one outer electrode that is located at an outer side among the upper electrode group is set to be wider than that of at least one inner electrode that is located between the at least one outer electrode and another outer electrode.

12. The plasma display panel according to claim 11, wherein the outer electrodes include:

a first sustaining electrode to which the scanning electrode is supplied; and a second sustaining electrode separated from the first sustaining electrode with the at least one inner electrode therebetween.

13. The plasma display panel according to claim 12, wherein a width of the first and the second sustaining electrodes is set to be wider than that of the at least one inner electrode.

14. The plasma display panel according to claim 1, wherein a width of the first sustaining electrode is set to be wider than that of the at least one inner electrode.

15. The plasma display panel according to claim 12, wherein a width of the second sustaining electrode is set to be equal to that of the at least one inner electrode.

16. The plasma display panel according to claim 11, further comprising:

a dielectric layer formed on the upper substrate to cover the upper electrode group;

a protective film deposited on the dielectric layer;

barrier ribs formed on the lower substrate for dividing the discharge space; and a fluorescent material layer formed on the surface of the barrier ribs and the lower substrate.

17. A plasma display panel, comprising:

an upper electrode group formed on an upper substrate, including a scanning electrode to which a scanning voltage is supplied and a pair trigger electrodes;

an address electrode formed on a lower substrate facing the upper substrate with a discharge space therebetween;

barrier ribs formed on the lower substrate for dividing the discharge space, thereby forming a discharge cell; and an auxiliary barrier rib configured to narrow a discharge space between the trigger electrodes.

18. The plasma display panel according to claim 17, wherein an upper portion and a lower portion of the discharge cell are broader than a central portion of the discharge cell due to the configuration of the auxiliary barrier rib.

19. The plasma display panel according to claim 17, wherein the auxiliary barrier rib comprises at least two auxiliary barrier ribs respectively extended from both sides of the barrier ribs and directly opposite to each other.

20. The plasma display panel according to claim 19, wherein the auxiliary barrier ribs are respectively formed under the pair of trigger electrodes.

21. The plasma display panel according to claim 17, wherein the upper electrode group further comprises a pair of sustaining electrodes that has a wider gap therebetween than the pair of trigger electrodes and wherein the pair of trigger electrodes are arranged between the pair of sustaining electrodes.

22. The plasma display panel according of claim 17, wherein the auxiliary barrier rib is formed under one of the pair of trigger electrodes, the one to which a scanning voltage is supplied.

23. The plasma display panel according t claim 17, wherein the auxiliary barrier rib extends in a direction of a width of the barrier ribs.

* * * * *